US008117029B2

(12) United States Patent
Kim et al.

(10) Patent No.: US 8,117,029 B2
(45) Date of Patent: Feb. 14, 2012

(54) METHOD AND APPARATUS FOR MATCHING SOUND QUALITY MEASUREMENT SECTIONS OF VARIABLE BANDWIDTH MULTI-CODEC

(75) Inventors: Dae-Ho Kim, Daejeon (KR); Tae-Gyu Kang, Daejeon (KR); Ki-Jong Koo, Daejeon (KR); Do Young Kim, Daejeon (KR); Hae Won Jung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 1141 days.

(21) Appl. No.: 11/928,557

(22) Filed: Oct. 30, 2007

(65) Prior Publication Data

US 2008/0133248 A1 Jun. 5, 2008

(30) Foreign Application Priority Data

Dec. 4, 2006 (KR) ..... 10-2006-0121817
Jul. 4, 2007 (KR) ..... 10-2007-0067187

(51) Int. Cl.
*G10L 21/00* (2006.01)

(52) U.S. Cl. ..... 704/221; 704/500; 375/240.23

(58) Field of Classification Search ..... 704/221, 704/500; 375/240.23
See application file for complete search history.

(56) References Cited

U.S. PATENT DOCUMENTS 6,718,296 B1 * 4/2004 Reynolds et al. ..... 704/200.1
2004/0215448 A1 * 10/2004 Funatsu et al. ..... 704/201
2005/0244012 A1 * 11/2005 Asada ..... 381/56

FOREIGN PATENT DOCUMENTS

KR 1020040076101 A 8/2004
KR 1020050092177 A 9/2005

OTHER PUBLICATIONS

J. Rosenberg, et al; "SIP: Session Initiation Protocol Jun. 2002" Standards Track, Request for Comments: 3261 The Internet Society (2002) pp. 1-15.
H. Schulzrinne, et al.; "AV Profile Jan. 1996;" Standards Track, Request for Comments 1890, The Internet Society (2002) pp. 1-14.
H. Schulzrinne, et al; "Tones, May 2000;" Standards Track, Request for Comments: 2833, The Internet Society (2000) pp. 1-23.
J. Rosenberg, et al.; An Offer/Answer Model with the Session Description Protocol (SDP), Jun. 2002, Standards Track, Request for Comments: 3264, The Internet Society (2002) pp. 1-19.
M. Handley, et al.; "SDP: Session Description Protocol, Apr. 1998;" Standards Track, Request for Comments: 2327, The Internet Society (1998) pp. 1-32.

* cited by examiner

*Primary Examiner* — Daniel D Abebe
(74) *Attorney, Agent, or Firm* — Ladas & Parry LLP

(57) ABSTRACT

Provided is a transmission apparatus for matching sound quality measurement sections of a variable bandwidth multi-codec. The apparatus includes a measurement section setting unit setting a measurement section, which is to be measured for sound quality, in units of time; a first conversion unit converting the measurement section into a measurement section in units of samples; and an information synthesis unit synthesizing information regarding the measurement section in units of samples with a digital original sound and outputting the synthesis result. In addition, provided is a method of matching a measurement section of a reference sound, based on which the end-to-end sound quality measurement of the variable bandwidth multi-codec is performed, and a measurement section of a sound produced by the variable bandwidth multi-codec in a real-time Internet multimedia service. Therefore, distortion of measurement results due to un-matching measurement sections can be reduced.

14 Claims, 3 Drawing Sheets

METHOD AND APPARATUS FOR MATCHING SOUND QUALITY MEASUREMENT SECTIONS OF VARIABLE BANDWIDTH MULTI-CODEC

This application claims the priority of Korean Patent Application No. 10-2006-0121817, filed on Dec. 4, 2006 and Korean Patent Application No. 10-2007-0067187, filed on Jul. 4, 2007 in the Korean Intellectual Property Office, the disclosures of which are incorporated herein in their entirety by reference.

BACKGROUND OF THE INVENTION

1. Field of the Invention

The present invention relates to a method and apparatus for matching sound quality measurement sections of a variable bandwidth multi-codec, and more particularly, a method and apparatus for matching sound quality measurement sections of a variable bandwidth multi-code, the method and apparatus capable of enabling a sound quality measurement apparatus to compare transmission rates of the variable bandwidth multi-codec according to transmission capabilities of a network, transmission delays in the network, packet losses, central processing unit (CPU) usage rates, a natural sound and an output sound of the variable bandwidth multi-codec, and the output sound of the variable bandwidth multi-codec and a sound received over the network for the same sound quality measurement sections when a real-time multimedia service is provided using the variable bandwidth multi-codec, which provides different transmission rates to a caller and the called, and using a connection function between a packet network and an existing wired/wireless network.

The present invention is supported by an information technology (IT) research and development (R&D) program of Ministry of Information and Communication (MIC)/Institute for Information Technology Advancement (IITA) [2005-S-100-02, "Development of Multi-Codec and Its Control Technology Providing Variable Bandwidth Scalability"].

2. Description of the Related Art

A variable bandwidth multi-codec is a technology for converting a natural sound into digitized codec data having a plurality of transmission rates. One example is a codec technology that can divide a frequency band into a narrowband (from 300 Hz to 3,400 Hz), a broadband (from 50H to 7,000 Hz) and an audio band (from 20 to 20,000 Hz), and produce transmission rates of 8, 12, 14, 16, 18, 20, 22, 24, 26, 28, 30, and 32 bps in each bandwidth.

In a voice over Internet protocol (VoIP) voice call service, a bandwidth provided by a network is variable and unpredictable. For example, a transmission rate of 32 bps of a variable bandwidth multi-codec is a codec transmission rate that produces the best sound quality, and a transmission rate of 8 kpbs is a codec transmission rate that produces the worst sound quality. If the network has available bandwidth and thus data having high bit rate can be, data can be transmitted at a transmission rate of 32 kbps. If the network condition deteriorates due to changes in the network bandwidth, the transmission rate is lowered to 30 kbps, 28 kbps, or the like, so that data can be slowly transmitted over the network although their quality is degraded. In the variable bandwidth multi-codec, if the transmission rate is high, sound quality is good. However, there is a high probability that a transmission loss and delay will occur in the network. On the other hand, if the transmission rate is low, sound quality is poor. However, there is a low probability that the transmission loss and delay will occur in the network.

When sound quality of the variable bandwidth multi-codec is measured on an end-to-end manner, it can be accurately measured, thereby making it possible to accurately control the transmission rate. That is, accurate control of the transmission rate requires accurate measurement of sound quality. Sound quality measurement refers to a process of comparing a file in which a natural sound is recorded to a file in which an output sound of a codec is recorded. In this process, if sound sections included in the two files are different from each other, accurate sound quality measurement is not possible.

Conventional technologies cannot find causes of sound quality distortion that occurs while subjects of end-to-end sound quality measurement are selected. Hence, a method and apparatus for finding causes of sound quality distortion by measuring a natural sound, a file stored after original sound data is converted using a variable bandwidth multi-codec according to changes in the condition of network bandwidth, and a group of files received over a network by using a sound quality measurement algorithm are required.

SUMMARY OF THE INVENTION

The present invention provides an apparatus and method for matching sound quality measurement sections of a natural sound (hereinafter, referred to as a "digital original sound") and a real-time multimedia service sound (hereinafter, referred to as a "digital inverse conversion sound") and thus performing accurately sound quality measurement.

According to an aspect of the present invention, there is provided a transmission apparatus for matching sound quality measurement sections of a variable bandwidth multi-codec. The apparatus includes a measurement section setting unit setting a measurement section, which is to be measured for sound quality, in units of time; a first conversion unit converting the measurement section in units of time into units of samples; and an information synthesis unit synthesizing information regarding the measurement section in units of samples with a digital original sound and outputting the synthesis result.

According to another aspect of the present invention, there is provided a reception apparatus for matching sound quality measurement sections of a variable bandwidth multi-codec and measuring sound quality of the variable bandwidth multi-codec by receiving information regarding a measurement section and a digital original sound. The apparatus includes an information extraction unit extracting the information regarding the measurement section and the digital original sound from received data; a second conversion unit converting the extracted information into information in units of bytes; and a sound extraction unit extracting a sound, which is to be measured and corresponds to the measurement section, based on the information in units of bytes.

According to another aspect of the present invention, there is provided an apparatus for matching sound quality measurement sections of a variable bandwidth multi-codec. The apparatus includes a measurement information transmission unit synthesizing information regarding a sound quality measurement section with a digital original sound into one data and transmitting the data; and a measurement information reception unit receiving the data, dividing the data into the information and the digital original sound, and generating sound data regarding the sound quality measurement section according to the information.

According to another aspect of the present invention, there is provided a method of matching sound quality measurement sections of a variable bandwidth multi-codec and measuring sound quality when a sound quality measurement transmission apparatus and a sound quality measurement reception apparatus are connected by a network. The method includes synthesizing information regarding a sound quality measurement section with a digital original sound into one data and transmitting the data by using the sound quality measurement transmission apparatus; and receiving the data, dividing the data into the information and the digital original sound, and generating sound data which corresponds to the sound quality measurement section included in the information by using the sound quality measurement reception apparatus.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth therein; rather, these embodiments are provided so that this disclosure will be thorough and complete, and will fully convey the concept of the invention to those skilled in the art. A detailed description might be omitted when it is determined that related prior art may unnecessarily obscure the point of the present invention.

Hereinafter, embodiments of the present invention will be described in detail with reference to the attached drawings.

Figure 1A:
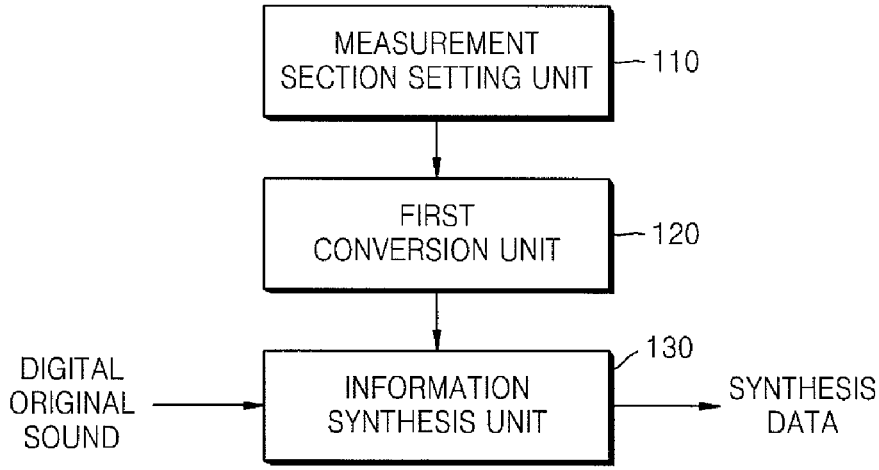
FIG. 1A is a block diagram of a measurement information transmission apparatus for matching sound quality measurement sections of a variable bandwidth multi-codec according to an embodiment of the present invention.
Figure 1B:
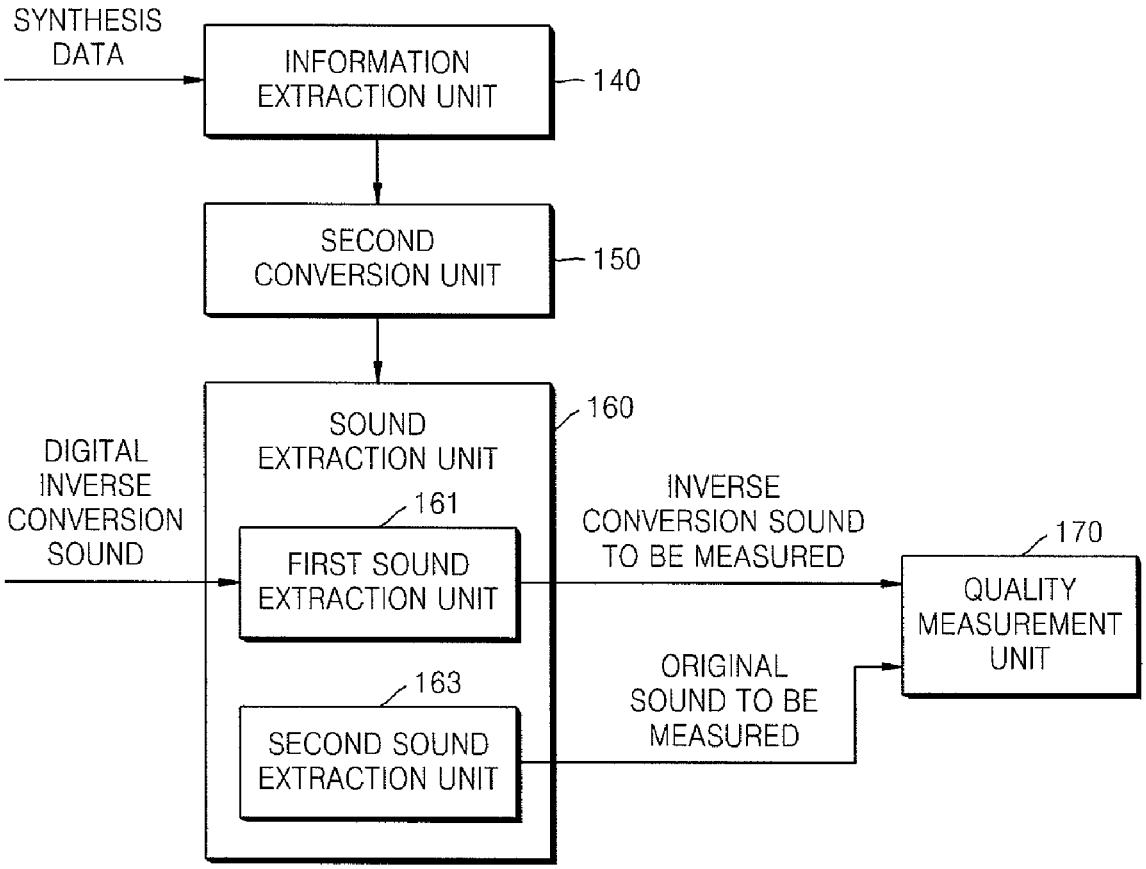
FIG. 1B is a block diagram of a measurement information reception apparatus for matching sound quality measurement sections of a variable bandwidth multi-codec according to an embodiment of the present invention.
Figure 2:
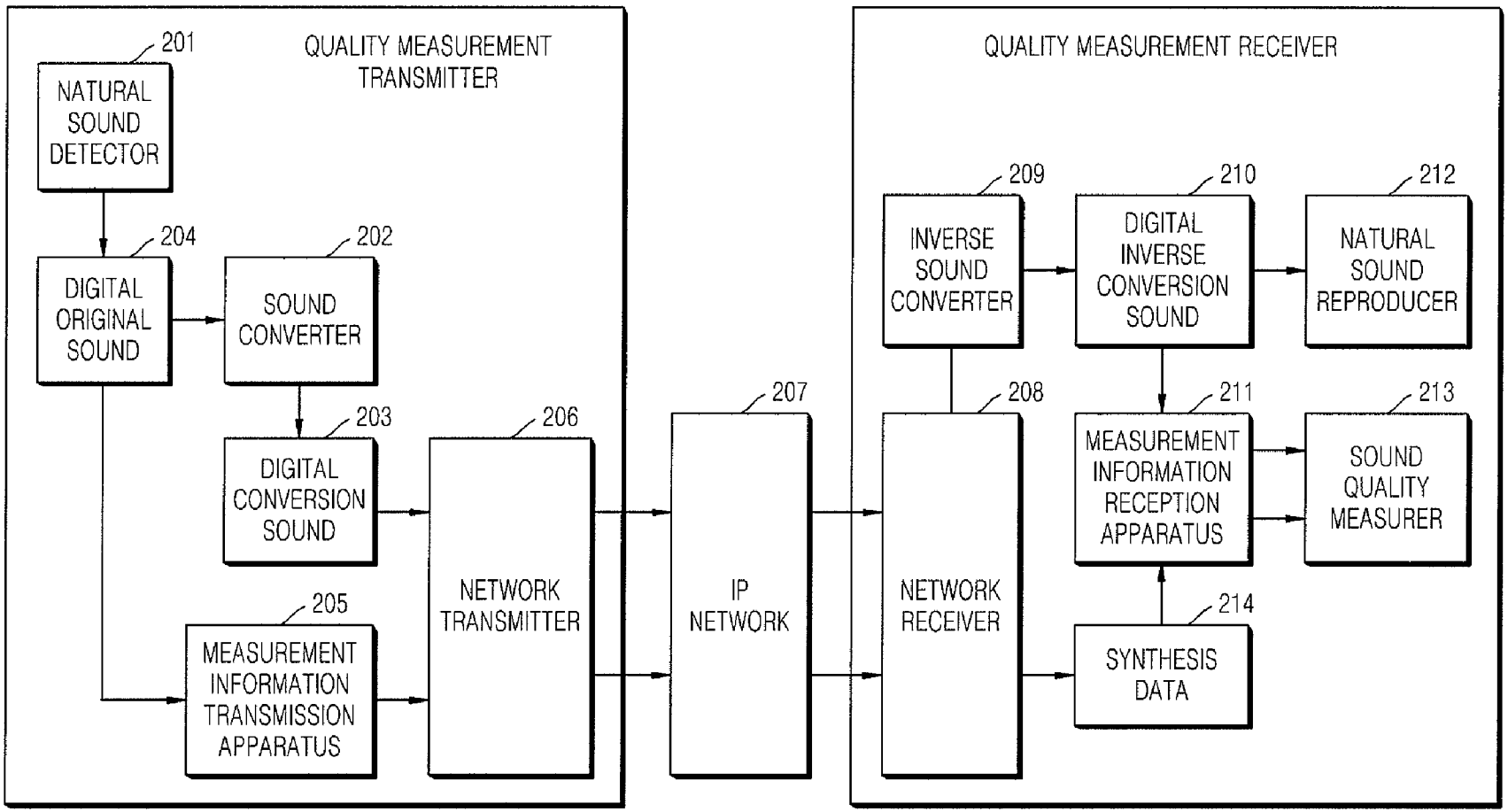
FIG. 2 is a block diagram of an apparatus for matching sound quality measurement sections of a variable bandwidth multi-codec according to an embodiment of the present invention.
Figure 3:
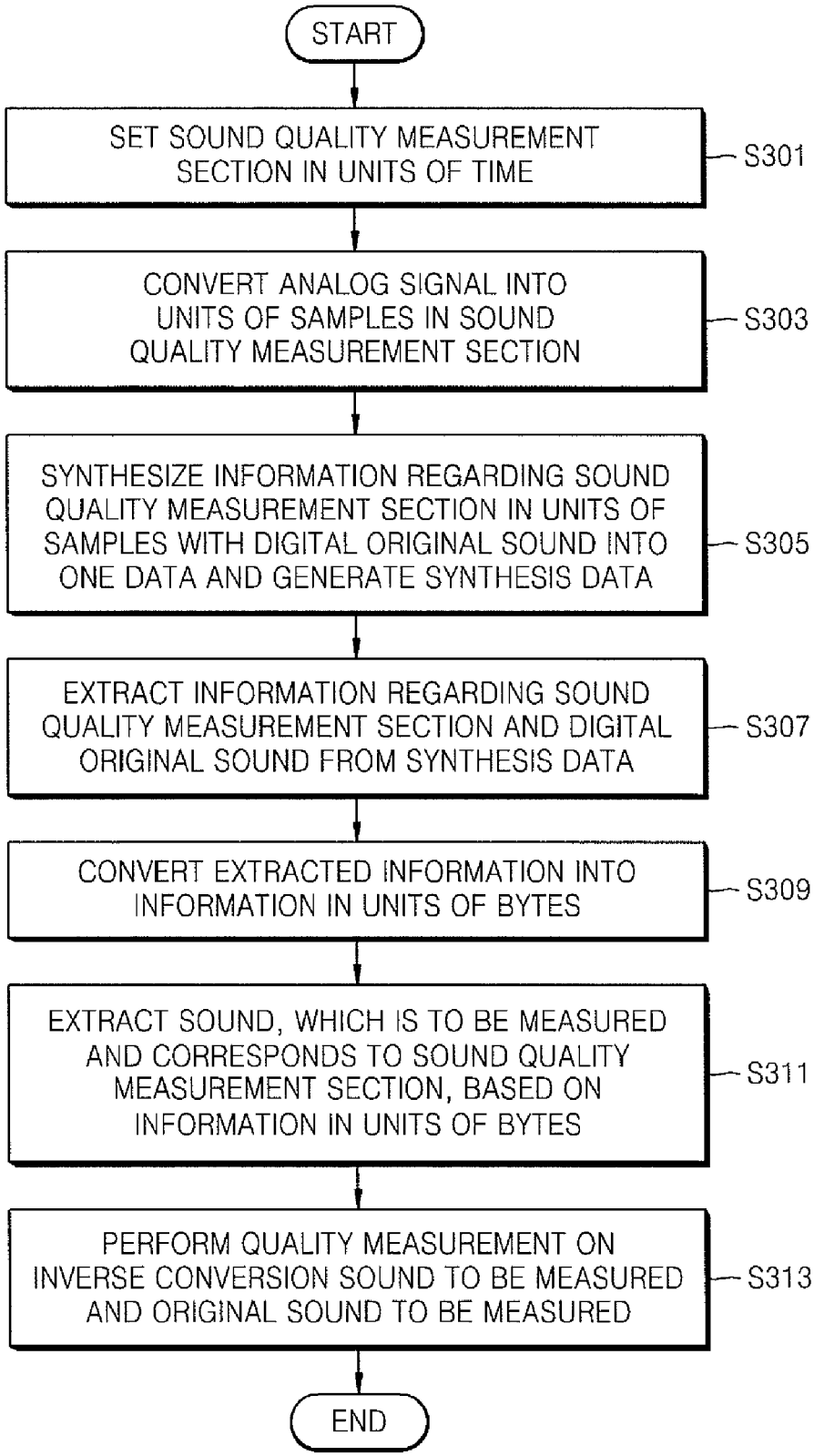
FIG. 3 is a flowchart illustrating a method of matching sound quality measurement sections of a variable bandwidth multi-codec according to an embodiment of the present invention.

FIG. 1A is a block diagram of a measurement information transmission apparatus for matching sound quality measurement sections of a variable bandwidth multi-codec according to an embodiment of the present invention. FIG. 1B is a block diagram of a measurement information reception apparatus for matching sound quality measurement sections of a variable bandwidth multi-codec according to an embodiment of the present invention. FIG. 2 is a block diagram of an apparatus for matching sound quality measurement sections of a variable bandwidth multi-codec according to an embodiment of the present invention. FIG. 3 is a flowchart illustrating a method of matching sound quality measurement sections of a variable bandwidth multi-codec according to an embodiment of the present invention.

In the following embodiments, processing a call between a caller and the called according to an International Engineering Task Force (IETF) standard will be described as an example. Since a call from the caller to the called is processed according to the IETF standard, new inventions not included in the IETF standard will be described below.

Referring to FIG. 1A, the measurement information transmission apparatus includes a measurement section setting unit 110, a first conversion unit 120, and an information synthesis unit 130. The measurement information transmission apparatus receives a desired sound quality measurement section from a user in units of time, converts the sound quality measurement section in units of time into a sound quality measurement section in units of samples, synthesizes information regarding the sound quality measurement section in units of samples with a digital original sound into one data, and transmits the data to the measurement information reception apparatus illustrated in FIG. 1B.

Specifically, the measurement section setting unit 110 receives a desired sound quality measurement section from a user in units of time and transmits the sound quality measurement section in units of time to the first conversion unit 120 in operation S301.

The first conversion unit 120 converts the sound quality measurement section in units of time, which is received from the measurement section setting unit 110, into a sound quality measurement section in units of samples and transmits information regarding the sound quality measurement section in units of samples to the information synthesis unit 130 in operation S303.

The information synthesis unit 130 synthesizes the information regarding the sound quality measurement section in units of samples, which is received from the first conversion unit 120, with a digital original sound into one data and outputs the data as synthesis data. The synthesis data is transmitted to the measurement information reception apparatus over a network in operation S305.

The digital original sound is an original sound based on which the quality of a digital sound converted from an analog sound input can be measured.

The measurement information reception apparatus illustrated in FIG. 1B includes an information extraction unit 140, a second conversion unit 150, and a sound extraction unit 160. The information extraction unit 140 extracts the information regarding the sound quality measurement section in units of samples and the digital original sound from the received synthesis data. The second conversion unit 150 converts the extracted information into information in units of bytes. The sound extraction unit 160 extracts a sound, which corresponds to the sound quality measurement section, based on the information in units of bytes.

The sound extraction unit 160 includes a first sound extraction unit 161 and a second sound extraction unit 163. The first sound extraction unit 161 extracts an inverse conversion sound, which is to be measured and corresponds to the sound quality measurement section included in the information in units of bytes, from a digital inverse conversion sound obtained by encoding and decoding the digital original sound using the variable bandwidth multi-codec. The second sound extraction unit 163 extracts an original sound, which is to be measured and corresponds to the sound quality measurement section included in the information in units of bytes, from the digital original sound. The measurement information reception apparatus may further include a quality measurement unit 170 comparing the extracted inverse conversion sound and the extracted original sound and thus measuring the quality of transmitted sound data.

Specifically, the information extraction unit 140 extracts the information regarding the sound quality measurement section in units of samples from the synthesis data received over the network. Then, the extracted information is transmitted to the second conversion unit 150, and the digital original sound is transmitted to the second sound extraction unit 163 in operation S307.

The second conversion unit 150 converts the extracted information into information in units of bytes and transmits the information in units of bytes to the first sound extraction unit 161 and the second sound extraction unit 163 in operation S309.

The first sound extraction unit 161 receives the digital inverse conversion sound obtained by encoding and decoding the digital original sound using the variable bandwidth multi-codec and extracts the inverse conversion sound, which is to be measured, using the information in units of bytes which is received from the second conversion unit 150. In this case, starting with first inverse conversion sound data, the first sound extraction unit 161 extracts the inverse conversion sound, which is to be measured and corresponds to the sound quality measurement section, by using the information about the sound quality measurement section in units of bytes (A bytes to B bytes where B is always greater than A). That is, starting with a first byte of the first inverse conversion sound data, data from A to B bytes is used as the inverse conversion sound to be measured.

The second sound extraction unit 163 extracts an original sound, which is to be measured, from the digital original sound which is received from a second measurement section information (not shown) using the information received from the second conversion unit 150 in operation S311.

The digital inverse conversion sound is sound data obtained after a digital natural sound is encoded and decoded using the variable bandwidth multi-codec.

The inverse conversion sound to be measured is sound data which is extracted from the digital original sound according to the sound quality measurement section.

FIG. 2 is a block diagram of a sound quality measurement apparatus including a measurement information transmission apparatus 205 and a measurement information reception apparatus 211. The sound quality measurement apparatus includes a natural sound detector 201, a sound converter 202, the measurement information transmission apparatus 205, a network transmitter 206, a network receiver 208, an Internet protocol (IP) network 207, an inverse sound converter 209, the measurement information reception apparatus 211, a sound quality measurer 213, and a natural sound reproducer 212.

The natural sound detector 201 is a device that converts a sound of a human voice or nature into a digital sound. The natural sound detector 201 produces a digital original sound 204 and transmits the digital original sound 204 to the sound converter 202 and the measurement information transmission apparatus 205.

The sound converter 202 encodes the digital original sound 204 produced by the natural detector 201 and generates a digital conversion sound 203. The digital conversion sound 203 is sent to the network transmitter 206, which, in turn, transmits the digital conversion sound 203 to a quality measurement receiver over the IP network 207.

The measurement information transmission apparatus 205 receives a sound quality measurement section from a user in units of time, converts the sound quality measurement section in units of time into a sound quality measurement section in units of samples, and synthesizes information regarding the sound quality measurement section in units of samples with the digital original sound 204 into one data. The measurement information transmission apparatus 205 is identical to the measurement information transmission apparatus of FIG. 1A.

The network transmitter 206 receives the digital conversion sound 203 from the sound converter 202 and the data from the measurement information transmission apparatus 205, and transmits the digital conversion sound 203 and the data to the IP network 207. In this case, network protocols, i.e., transmission control protocol (TCP)/IP and user datagram protocol (UDP)/IP, are used.

The network receiver 208 of the quality measurement receiver collects the digital conversion sound 203 and the data transmitted through the IP network 207. Then, the digital original sound 204 and the information regarding the sound quality measurement section in units of samples, which were transmitted using the TCP, are stored again as synthesis data 214. In addition, the digital conversion sound 203 transmitted using the UDP is converted and stored as a digital inverse conversion sound 210 by the inverse sound converter 209.

The measurement information reception apparatus 211 extracts a sound, which corresponds the sound quality measurement section, from the synthesis data 214 and the digital inverse conversion sound 210 collected by the quality measurement receiver and transmits the extracted sound to the sound quality measurer 213. Accordingly, the sound quality measurer 213 measures the received sound. The natural sound reproducer 212 receives and reproduces the digital inverse conversion sound 210.

The network receiver 208 extracts desired data based on real-time transport protocol (RTP)/UDP standards and TCP standards.

The inverse sound converter 209 inversely converts, that is, decodes, sound data received through the IP network 207 into data that can be reproduced by the natural sound reproducer 212.

The measurement information reception apparatus 211 receives the synthesis data 214 from the network receiver 208 and divides the synthesis data 214 into the information regarding the sound quality measurement section in units of samples and the digital original sound 204. Using the information regarding the sound quality measurement section in units of samples, the measurement information reception apparatus 211 extracts data, which corresponds to the sound quality measurement section, from the digital inverse conversion sound 210 received from the inverse sound converter 209 and the digital original sound 204. The measurement information reception apparatus 211 is identical to the measurement information reception apparatus of FIG. 1B.

The sound quality measurer 213 receives a digital original sound to be measured and an inverse conversion sound to be measured from the measurement information reception apparatus 211 and performs sound quality tests using various algorithms.

The natural sound reproducer 212 reproduces the digital inverse conversion sound 210.

The present invention can also be implemented as computer-readable code on a computer-readable recording medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, optical data storage devices, and carrier waves (such as data transmission through the Internet).

The computer-readable recording medium can also be distributed over network-coupled computer systems so that the computer-readable code is stored and executed in a distributed fashion. Also, functional programs, code, and code segments for accomplishing the present invention can be easily construed by programmers skilled in the art to which the present invention pertains.

As described above, a method and apparatus for matching sound quality measurement sections of a variable bandwidth multi-codec according to the present invention provide a method of matching a measurement section of a reference sound, based on which the end-to-end sound quality measurement of the variable bandwidth multi-codec is performed, and a measurement section of a sound produced by the variable bandwidth multi-codec in a real-time Internet multimedia service. Therefore, distortion of measurement results due to un-matching measurement sections can be reduced.

For accurate quality measurement, data to be measured for its sound quality can be stored while each of a digital original sound and a digital inverse conversion sound has a start point and an end point. In addition, accurate sound quality measurement values can be produced.

The variable bandwidth multi-codec having a variable network transmission bit rate is transmitted to a network and provides a sound quality measurement method and measurement results based on which causes of sound quality distortion which can be identified. Hence, the variable bandwidth multi-codec can be used in Internet telephony (a voice over Internet protocol (VoIP)).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A transmission apparatus for matching sound quality measurement sections of a variable bandwidth multi-codec, the apparatus comprising:

a measurement section setting unit setting a measurement section, which is to be measured for sound quality, in units of time;

a first conversion unit converting the measurement section in units of time into units of samples;

an information synthesis unit synthesizing information regarding the measurement section in units of samples with a digital original sound and outputting the synthesis result; and a sound converter unit encoding the digital original sound using the variable bandwidth multi-codec and generating a digital conversion sound.

2. A reception apparatus for matching sound quality measurement sections of a variable bandwidth multi-codec by receiving information regarding a measurement section and a digital original sound, the apparatus comprising:

an information extraction unit extracting the information regarding the measurement section and the digital original sound from received data;

a first conversion unit converting the extracted information into information in units of bytes; and a sound extraction unit extracting a sound, which is to be measured and corresponds to the measurement section, based on the information in units of bytes.

3. The apparatus of claim 2, wherein the sound extraction unit comprises:

a first sound extraction unit extracting an inverse conversion sound, which is to be measured and corresponds to the measurement section included in the information in units of bytes, from a digital inverse conversion sound obtained by encoding and decoding the digital original sound using the variable bandwidth multi-codec; and a second sound extraction unit extracting an original sound, which is to be measured and corresponds to the measurement section included in the information in units of bytes, from the digital original sound.

4. The apparatus of claim 3, wherein the sound extraction unit further comprises a quality measurement unit measuring quality of the extracted inverse conversion sound and the extracted original sound.

5. The apparatus of claim 2, further comprising an inverse sound converter unit decoding a digital conversion sound using the variable bandwidth multi-codec and generating a digital inverse conversion sound.

6. An apparatus for matching sound quality measurement sections of a variable bandwidth multi-codec, the apparatus comprising:

a measurement information transmission unit synthesizing information regarding a sound quality measurement section with a digital original sound into one data and transmitting the data; and a measurement information reception unit receiving the data, dividing the data into the information and the digital original sound, and generating sound data regarding the sound quality measurement section according to the information.

7. The apparatus of claim 6, wherein the measurement information transmission unit comprises:

a measurement section setting unit setting the sound quality measurement section, which is to be measured for sound quality, in units of time;

a first conversion unit converting the sound quality measurement section in units of time into units of samples; and an information synthesis unit synthesizing information regarding the sound quality measurement section in units of samples with the digital original sound and outputting the synthesis result.

8. The apparatus of claim 6, wherein the measurement information reception unit comprises:

an information extraction unit extracting the information regarding the sound quality measurement section and the digital original sound from the received data;

a second conversion unit converting the extracted information into information in units of bytes; and a sound extraction unit extracting a sound, which is to be measured and corresponds to the measurement section, based on the information in units of bytes.

9. The apparatus of claim 8, wherein the sound extraction unit comprises:

a first sound extraction unit extracting an inverse conversion sound, which is to be measured and corresponds to the sound quality measurement section included in the information in units of bytes, from a digital inverse conversion sound obtained by encoding and decoding the digital original sound using the variable bandwidth multi-codec; and a second sound extraction unit extracting an original sound, which is to be measured and corresponds to the measurement section included in the information in units of bytes, from the digital original sound.

10. A method of matching sound quality measurement sections of a variable bandwidth multi-codec and measuring sound quality when a sound quality measurement transmission apparatus and a sound quality measurement reception apparatus are connected by a network, the method comprising:

synthesizing information regarding a sound quality measurement section with a digital original sound into one data and transmitting the data by using the sound quality measurement transmission apparatus; and receiving the data, dividing the data into the information and the digital original sound, and generating sound data regarding the sound quality measurement section according to the information by using the sound quality measurement reception apparatus.

11. The method of claim 10, wherein the synthesizing of the information regarding the sound quality measurement section with the digital original sound into one data and the transmitting of the data comprises:

setting the sound quality measurement section in units of time;

converting the sound quality measurement section into a sound quality measurement section in units of samples in which an analog signal is converted into a digital signal; and synthesizing information regarding the sound quality measurement section in units of samples with the digital original sound into synthesis data and outputting the synthesis data.

12. The method of claim 10, wherein the generating of the sound data comprises:

extracting the information regarding the sound quality measurement section and the digital original sound from the received data;

converting the extracted information into information in units of bytes; and extracting a sound, which is to be measured and corresponds to the sound quality measurement section, based on the information in units of bytes.

13. The method of claim 12, wherein the extracting of the sound, which is to be measured and corresponds to the sound quality measurement section, comprises:

extracting an inverse conversion sound, which is to be measured and corresponds to the sound quality measurement section included in the information in units of bytes, from a digital inverse conversion sound obtained by encoding and decoding the digital original sound using the variable bandwidth multi-codec; and extracting an original sound, which is to be measured and corresponds to the sound quality measurement section included in the information in units of bytes, from the digital original sound.

14. The method of claim 13, further comprising measuring quality of the extracted inverse conversion sound and the extracted original sound.

* * * * *